United States Patent [19]

Baginski et al.

[11] Patent Number: 4,652,392

[45] Date of Patent: Mar. 24, 1987

[54] CONTROLLED SUDSING DETERGENT COMPOSITIONS

[75] Inventors: Richard M. Baginski, West Chester, Ohio; Bernard C. Dems, Syracuse, N.Y.; Linda A. Ross; Ralph H. Soule, Jr., both of Cincinnati, Ohio

[73] Assignee: The Procter & Gamble Company, Cincinnati, Ohio

[21] Appl. No.: 760,421

[22] Filed: Jul. 30, 1985

[51] Int. Cl.[4] ..... C11D 3/20; C11D 17/06

[52] U.S. Cl. ..... 252/109; 252/135; 252/174; 252/174.13; 252/174.15; 252/174.21; 252/531; 252/532; 252/539; 252/540; 252/546; 252/550; 252/551; 252/558; 252/559

[58] Field of Search ..... 252/135, 174.13, 174.15, 252/174, 174.21, 109

[56] References Cited

U.S. PATENT DOCUMENTS

| | | | |
|---|---|---|---|
| 3,933,672 | 1/1976 | Bartolotta et al. | 252/116 |
| 4,290,903 | 9/1981 | Macgilp et al. | 252/91 |
| 4,294,711 | 10/1981 | Hardy et al. | 252/8.75 |
| 4,339,342 | 7/1982 | Hempel et al. | 252/174.25 |
| 4,400,288 | 8/1983 | Dhanani et al. | 252/135 |
| 4,419,260 | 12/1983 | Reuter et al. | 252/174.13 |
| 4,451,387 | 5/1984 | Tai | 252/174.15 |
| 4,552,681 | 11/1985 | Koch et al. | 252/140 |

FOREIGN PATENT DOCUMENTS

| | | |
|---|---|---|
| 91802 | 10/1983 | European Pat. Off. . |
| 1207777 | 10/1970 | United Kingdom . |

*Primary Examiner*—Prince E. Willis

*Attorney, Agent, or Firm*—Robert B. Aylor; Richard C. Witte; Thomas H. O'Flaherty

[57] ABSTRACT

Granular detergent compositions having an effective suds controlling agent comprising a suds-controlling silicone material which is substantially removed from contact with the surfactant component or alkaline component of the composition by incorporation in, e.g., a polyethylene glycol carrier, with preferably a small amount of fatty acid, in an irregularly shaped particle having a minimum dimension of at least about 0.05 cm. and being substantially free of water soluble inorganic salts.

15 Claims, No Drawings

CONTROLLED SUDSING DETERGENT COMPOSITIONS

TECHNICAL FIELD AND BACKGROUND ART

The present invention relates to detergent compositions containing as an essential ingredient a silicone suds controlling agent which is stable on storage. The concept of "stability" as used herein is in the context of protecting the silicone and preserving, maintaining or promoting its capability of suppressing, or controlling, the suds profile of a detergent surface active agent. More specifically, the invention in its broadest context encompasses detergent compositions comprising a detergent surfactant component and a silicone suds controlling agent which is separated, or isolated, within a protective matrix from the detergent surfactant.

Silicones are widely known and taught for use as highly effective suds controlling agents. For example, U.S. Pat. No. 3,455,839 relates to compositions and processes for defoaming aqueous solutions by incorporating therein small amounts of polydimethylsiloxane fluids.

Useful suds controlling silicones are mixtures of silicone and silanated silica as described, for instance, in German Patent Application DOS No. 2,124,526.

Additionally, German Pat. No. 2,232,262 relates to silicone suds controlling agents comprising sodium tripolyphosphate surface-coated with an organopolysiloxane.

Silicone defoamers and suds controlling agents have been successfully incorporated into a detergent composition by protecting them as in U.S. Pat. No. 3,933,672, Bartolotta et al. All of the above patents are incorporated herein by reference.

The interaction of the detergent material with the silicone on storage, has been minimized by isolating the silicone material from said detergents to provide compositions having controlled suds patterns even after prolonged storage.

SUMMARY OF THE INVENTION

The present invention encompasses granular detergent compositions having a controlled suds pattern, comprising:

(a) a suds suppressing amount of a stable suds controlling component especially adapted for use in a detergent composition, comprising a silicone suds controlling agent releasably incorporated in a water-soluble or water-dispersible, substantially non-surface active, detergent-impermeable, and non-hygroscopic carrier, said component being substantially free of hygroscopic water-soluble inorganic salts, and in the form of irregularly shaped particles having a minimum dimension not less than about 0.05 cm and a maximum dimension being at least about 20% greater than the minimum dimension; and (b) a sudsing detergent component selected from the group consisting of anionic, nonionic, zwitterionic, ampholytic, and cationic detergents and mixtures thereof.

The silicone suds controlling component of the instant compositions is employed herein in a "suds suppressing amount". By "suds suppressing amount" is meant that the formulator of the compositions can select an amount of this component which will control the suds to the extent desired. The amount of suds controller will vary with the detergent component selected. For example, with high sudsing surfactants, relatively more of the controller is used to achieve the desired suds control than with low foaming detergents.

The silicone suds controlling component herein comprises a silicone suds controlling agent of the type hereinafter disclosed which is substantially isolated from the detergent component of the composition. This "isolation" is achieved by incorporating the silicone agent in a water-soluble or water-dispersible organic carrier matrix. As in U.S. Pat. No. 3,933,672, the matrix, itself, must be a substantially non-surface active, non-hygroscopic, material which does not interact with the silicone agent. Moreover, the carrier must be substantially impenetrable by the detergent component of the detergent composition to prevent undesirable silicone/detergent and/or silicone/alkalinity interactions.

Moreover, the carrier matrix herein must not contain added surface active agents, other than the silicone.

DETAILED DESCRIPTION OF THE INVENTION

The compositions of the present invention comprise two essential components, the irregularly shaped particulate silicone suds controlling component substantially free of hygroscopic water soluble inorganic salts and the detergent component. In order to provide a stable composition which provides good suds control even after storage, it is necessary to isolate the silicone component from the detergent component in the manner hereinafter disclosed. The individual components of the compositions herein are described in detail, below.

SUDS CONTROLLING COMPONENT

The suds controlling component of the instant composition comprises a silicone suds controlling agent which is incorporated in a water-soluble or water-dispersible, substantially nonsurface active, detergent-impermeable and, non-hygroscopic carrier material. The carrier material contains within its interior substantially all of the silicone suds controlling agent and effectively isolates it from (i.e., keeps it out of contact with) the detergent component of the compositions. The carrier material is selected such that, upon admixture with water, the carrier matrix dissolves or disperses to release the silicone material to perform its suds controlling function.

The silicone materials employed as the suds controlling agents herein can be alkylated polysiloxane materials of several types, either singly or in combination with various solid materials such as silica aerogels and xerogels and hydrophobic silicas of various types. In industrial practice, the term "silicone" has become a generic term which encompasses a variety of relatively high molecular weight polymers containing siloxane units and hydrocarbyl groups of various types. In general terms, the silicone suds controllers can be described as siloxanes having the general structural backbone.

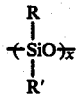

wherein x is from about 20 to about 2,000, and R and R′ are each alkyl or aryl groups, especially methyl, ethyl, propyl, butyl or phenyl. The polydimethylsiloxanes (R and R′ are methyl) having a molecular weight within the range of from about 200 to about 200,000, and higher, are all useful as suds controlling agents. Silicone materials are commercially available from the Dow Corning Corporation under the trade name Silicone 200 Fluids. Suitable polydimethylsiloxanes have a viscosity of from about 20 cs to about 60,000 cs, preferably from about 20–1500 cs, at 250° C. when used with silica and/or siloxane resin.

Additionally, other silicone materials wherein the side chain groups R and R′ are alkyl, aryl, or mixed alkyl and aryl hydrocarbyl groups exhibit useful suds controlling properties. These materials are readily prepared by the hydrolysis of the appropriate alkyl, aryl or mixed alkaryl or aralkyl silicone dichlorides with water in the manner well known in the art. As specific examples of such silicone suds controlling agents useful herein there can be mentioned, for example, diethyl polysiloxanes; dipropyl polysiloxanes; dibutyl polysiloxanes; methylethyl polysiloxanes; phenylmethyl polysiloxanes; and the like. The dimethyl polysiloxanes are particularly useful herein due to their low cost and ready availability.

The silicone "droplets" in the carrier matrix should be from about 1 to about 50 microns, preferably from about 5 to about 40 microns, more preferably from about 5 to about 30 microns in diameter for maximum effectiveness. Droplets below about 5 microns in diameter are not very effective and above about 30 microns in diameter are increasingly less effective. Similar sizes are required for the other silicone suds controlling agents disclosed hereinafter.

A second highly preferred type of silicone suds controlling agent useful in the compositions herein comprises a mixture of an alkylated siloxane of the type hereinabove disclosed and solid silica. Such mixtures of silicone and silica can be prepared by affixing the silicone to the surface of silica ($SiO_2$), for example by means of the catalytic reaction disclosed in U.S. Pat. No. 3,235,509 incorporated herein by reference. Suds controlling agents comprising mixtures of silicone and silica prepared in this manner preferably comprise silicone and silica in a silicone:silica ratio of from about 19:1 to about 1:2, preferably from about 10:1 to about 1:1. The silica can be chemically and/or physically bound to the silicone in an amount which is preferably about 5% to about 20%, preferably from about 10 to about 15%, by weight, based on the silicone. The particle size of the silica employed in such silica/silicone suds controlling agents should preferably be not more than about 1000, preferably not more than about 100 millimicrons, preferably from about 5 millimicrons to about 50 millimicrons, more preferably from about 10 to about 20 millimicrons, and the specific surface area of the silica should exceed about 5 $m^2/g$., preferably more than about 50 $m^2/g$.

Alternatively, suds controlling agents comprising silicone and silica can be prepared by admixing a silicone fluid of the type hereinabove disclosed with a hydrophobic silica having a particle size and surface area in the range disclosed above. Any of several known methods may be used for making a hydrophobic silica which can be employed herein in combination with a silicone as the suds controlling agent. For example, a fumed silica can be reacted with a trialkyl chlorosilane (i.e., "silanated") to affix hydrophobic trialkylsilane groups on the surface of the silica. In a preferred and well known process, fumed silica is contacted with trimethylchlorosilane and a preferred hydrophobic silanated silica useful in the present compositions is prepared.

In an alternate procedure, a hydrophobic silica useful in the present compositions is obtained by contacting silica with any of the following compounds: metal, ammonium and substituted ammonium salts of long chain fatty acids, such as sodium stearate, aluminum stearate, and the like; silylhalides, such as ethyltrichlorosilane, butyltrichlorosilane, tricyclohexylchlorosilane, and the like; and long chain alkyl amines or ammonium salts, such as cetyl trimethyl amine, cetyl trimethyl ammonium chloride, and the like.

A preferred suds controlling agent herein comprises a hydrophobic silanated (most preferably trimethylsilanated) silica having a particle size in the range from about 10 millimicrons to about 20 millimicrons and a specific surface area above about 50 $m^2/g$ intimately admixed with a dimethyl silicone fluid having a molecular weight in the range of from about 500 to about 200,000, at a weight ratio of silicone to silanated silica of from about 10:1 to about 1:2. Such suds controlling agents preferably comprise silicone and the silanated silica in a weight ratio of silicone:silanated silica of from about 10:1 to about 1:1. The mixed hydrophobic silanated (especially trimethylsilanated) silica-silicone suds controlling agents provide suds control over a broad range of temperatures, presumably due to the controlled release of the silicone from the surface of the silanated silica.

Another type of suds control agent herein comprises a silicone material of the type hereinabove disclosed sorbed onto and into a solid. Such suds controlling agents comprise the silicone and solid in a silicone:solid ratio of from about 20:1 to about 1:20, preferably from about 5:1 to about 1:1. Examples of suitable solid sorbents for the silicones herein include clay, starch, kieselguhr, Fuller's Earth, and the like. The alkalinity of the solid sorbents is of no consequence to the compositions herein, inasmuch as it has been discovered that the silicones are stable when admixed therewith. As disclosed hereinabove, the sorbent-plus-silicone suds controlling agent must be coated or otherwise incorporated into a carrier material of the type hereinafter disclosed to effectively isolate the silicone from the detergent component of the instant compositions.

Yet another preferred type of silicone suds controlling agent herein comprises a silicone fluid, a silicone resin and silica. The silicone fluids useful in such suds controlling mixtures are any of the types hereinabove disclosed, but are preferably dimethyl silicones. The silicone "resins" used in such compositions can be any alkylated silicone resins, but are usually those prepared from methylsilanes. Silicone resins are commonly described as "three-dimensional" polymers arising from the hydrolysis of alkyl trichlorosilanes, whereas the silicone fluids are "two-dimensional" polymers prepared by the hydrolysis of dichlorosilanes. The silica components of such compositions are microporous materials such as the fumed silica aerogels and xerogels having the particle sizes and surface areas hereinabove disclosed.

The mixed silicone fluid/silicone resin/silica materials useful in the present compositions can be prepared in the manner disclosed in U.S. Pat. No. 3,455,839. These mixed materials are commercially available from the Dow Corning Corporation. According to U.S. Pat. No. 3,455,839, such materials can be described as mixtures consisting essentially of:

for each 100 parts by weight of a polydimethylsiloxane fluid having a viscosity in the range from 20 cs. to 1500 cs. at 25° C., (a) from about 5 to about 50, preferably from about 5 to about 20, parts by weight of a siloxane resin composed of $(CH_3)_3SiO_{\frac{1}{2}}$ units and $SiO_2$ units in which the ratio of the $(CH_3)_3SiO_{\frac{1}{2}}$ units to the $SiO_2$ units is within the range of from about 0.6/1 to about 1.2/1; and (b) from about 1 to about 10, preferably from about 1 to about 5, parts by weight of a solid silica gel, preferably an aerogel.

Again, such mixed silicone/silicone resin/silica suds controlling agents must be combined with a detergent-impermeable carrier material to be useful in the compositions herein.

All of the above patents are incorporated herein by reference.

The silicone suds controlling agents of the aforementioned type must be incorporated within (i.e., coated, encapsulated, covered by, internalized, or otherwise substantially contained within) a substantially water-soluble, or water-dispersible, and non-hygroscopic carrier material which must be impermeable to detergents and alkalinity and which, itself, must be substantially nonsurface active. By substantially nonsurface active is meant that the carrier material, itself, does not interact with the silicone material in such fashion that the silicone material is emulsified or otherwise excessively dispersed prior to its release in the wash water. I.e., the particle size of the silicone droplet should be maintained above about 1, more preferably above about 5 microns.

Of course, when preparing a dry powder or granulated detergent composition, it is preferable that the silicone suds controlling component thereof also be substantially dry and nontacky at ambient temperatures. Accordingly, it is preferred herein to use as the carrier material, or vehicle, plastic, organic compounds which can be conveniently melted, admixed with the silicone suds controlling agent, and thereafter cooled to form solid flakes. There are a wide variety of such carrier materials useful herein. Since the silicone suds controlling agent is to be releasably incorporated in the carrier, such that the silicone is released into the aqueous bath upon admixture of the composition therewith, it is preferred that the carrier material be water soluble. However, water-dispersible materials are also useful, inasmuch as they will also release the silicone upon addition to an aqueous bath.

A wide variety of carrier materials having the requisite solubility/dispersibility characteristics and the essential features of being substantially non-surface active, substantially non-hygroscopic and substantially detergent-impermeable are known. However, polyethylene glycol (PEG) which has substantially no surface active characteristics is highly preferred herein. PEG, having molecular weights of from about 1,500 to about 100,000, preferably from about 3,000 to about 20,000, more preferably from about 5,000 to about 10,000 can be used.

Surprisingly, highly ethoxylated fatty alcohols such as tallow alcohol condensed with at least about 25 molar proportions of ethylene oxide are also useful herein. Other alcohol condensates containing extremely high ethoxylate proportions (about 25 and above) are also useful herein. Such high ethoxylates apparently lack sufficient surface active characteristics to interact or otherwise interfere with the desired suds control properties of the silicone agents herein. A variety of other materials useful as the carrier agents herein can also be used, e.g., gelatin; agar; gum arabic; and various algae-derived gels.

A very preferred carrier material is a mixture of from about 0.2% to about 15%, preferably from about 0.25% to about 5%, more preferably from about 0.25% to about 2% of fatty acids containing from about 12 to about 30, preferably from about 14 to about 20, more preferably from about 14 to about 16, carbon atoms and the balance PEG. Such a carrier material gives a more desirable suds pattern over the duration of the washing process, providing more suds at the start and less suds at the end than PEG alone. The fatty acid delays the solubility of the suds suppressor particle and thereby delays the release of the silicone.

The irregularly shaped particulate silicone suds controlling component of the present invention can be conveniently prepared in a highly preferred flake form by admixing the silicone suds controlling agent with a molten carrier material, mixing to form the appropriate silicone droplet size, and flaking, e.g., by milling or extruding to form a thin sheet, cooling to solidify the carrier material, and breaking the sheet into particles of the right size. In another preferred process thin films can be formed by cooling molten carrier material with the suds suppressor dispersed therein on, e.g., a chill roll or belt cooler and then breaking said film into appropriate sized flakes. The thickness of the flake should be from about 0.04 to about 0.15 cm, preferably from about 0.05 to about 0.1 cm. When this procedure is used, the silicone suds controlling agent is contained within the carrier material so effectively that when this material is eventually admixed with, or incorporated into, a detergent composition, the silicone does not substantially come into contact with the detergent surfactant ingredient.

In order to provide a granular, nontacky suds controlling component useful in dry granular detergent compositions, the flake of the silicone suds controlling agent and carrier material should be substantially solidified. This can be achieved by use of belt coolers and which quickly cool the sheets or flakes such that the carrier melt is hardened. Extrusion techniques can also be used.

It is to be recognized that the amount of carrier used to isolate the silicone suds controlling agent herein from the detergent component of the compositions herein is not critical. It is only necessary that enough carrier be used to provide sufficient volume that substantially all the silicone can be incorporated therein. Likewise, it is preferred to have sufficient carrier material to provide for sufficient strength of the resultant granule to resist premature breakage. Generally, above about a 2:1, preferably from about 5:1 to about 100:1, more preferably from about 20:1 to about 40:1, weight ratio of carrier to silicone suds controlling agent is employed.

The present invention preferably encompasses detergent compositions comprising a detergent component and a suds controlling component comprising an irregularly shaped particle, preferably a flake, consisting essentially of from about 1% to about 20%, preferably from about 1% to about 5%, most preferably about 2% to about 5%, by weight of a silicone suds controlling agent of any of the types hereinabove disclosed and the remainder being primarily a carrier material of the type hereinabove disclosed.

The size of the particles of the suds controlling component used in the present compositions is selected to be compatible with the remainder of the detergent composition. The suds controlling components herein do not segregate unacceptably within the detergent composition. In general, particles with a maximum dimension of from about 600 to about 2000, preferably from about 800 to about 1600 microns are compatible with spray-dried detergent granules. Therefore, the majority of the particles should have these maximum dimensions. The majority of the particles should have a ratio of the maximum to the minimum diameter of from about 1.5:1 to about 5:1, preferably from about 1.5:1 to about 4:1.

Detergent compositions comprising the suds control component and the detergent component can be provided having various ratios and proportions of these two materials. Of course, the amount of the suds control component can be varied, depending upon the suds profile desired by the formulator. Moreover, the amount of detergent component can be varied to provide either heavy-duty or light-duty products, as desired.

For most purposes, it is preferred to use a sufficient amount of the silicone suds controlling component in the detergent composition to provide a concentration of from about 0.0005% to about 10% by weight of the silicone suds controlling agent in the composition. A preferred amount of silicone suds controlling agent in the detergent composition lies within the range of from about 0.01% to about 0.5% by weight. Accordingly, the amount of suds control component will be adjusted, depending upon the amount of silicone suds control agent contained therein, to provide these desirable percentages of suds control agent.

DETERGENT COMPONENT

The amount of the detergent component can, as noted hereinabove, vary over a wide range which depends on the desires of the user. In general, the compositions contain from about 5% to about 50%, preferably from about 10% to about 30% by weight, of detergent.

The detergent compositions of the instant invention can contain all manner of organic, water-soluble detergent compounds so long as the silicone suds control agents are isolated therefrom. A typical listing of the classes and species of detergent compounds useful herein appear in U.S. Pat. No. 3,664,961, incorporated herein by reference. The following list of detergent compounds and mixtures which can be used in the instant compositions is representative of such materials, but is not intended to be limiting.

Water-soluble salts of the higher fatty acids, i.e., "soaps", are useful as the detergent component of the composition herein. This class of detergents includes ordinary alkali metal soaps such as the sodium, potassium, ammonium and alkanolammonium salts of higher fatty acids containing from about 8 to about 24 carbon atoms and preferably from about 10 to about 20 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

Another class of detergents includes water-soluble salts, particularly the alkali metal, ammonium and alkanolammonium salts, of organic sulfuric reaction products having in their molecular structure an alkyl group containing from about 8 to about 22 carbon atoms and a sulfonic acid or sulfuric acid ester group. (Included in the term "alkyl" is the alkyl portion of acyl groups.) Examples of this group of synthetic detergents which form a part of the detergent compositions of the present invention are the sodium and potassium alkyl sulfates, especially those obtained by sulfating the higher alcohols ($C_8$–$C_{18}$ carbon atoms) produced by reducing the glycerides of tallow or coconut oil; and sodium and potassium alkylbenzene sulfonates, in which the alkyl group contains from about 9 to about 15 carbon atoms, in straight chain or branched chain configuration, e.g. those of the type described in U.S. Pat. Nos. 2,220,099 and 2,477,383, incorporated herein by reference. Especially valuable are linear straight chain alkylbenzene sulfonates in which the average of the alkyl groups is about 12 carbon atoms, abbreviated as $C_{12}$ LAS.

Other anionic detergent compounds herein include the sodium alkyl glyceryl ether sulfonates, especially those ethers of higher alcohols derived from tallow and coconut oil; sodium coconut oil fatty acid monoglyceride sulfonates and sulfates; and sodium or potassium salts of alkyl phenol ethylene oxide ether sulfate containing from about 1 to about 10 units of ethylene oxide per molecule and wherein the alkyl groups contain about 8 to about 13 carbon atoms.

Water-soluble nonionic synthetic detergents are also useful as the detergent component of the instant composition. Such nonionic detergent materials can be broadly defined as compounds produced by the condensation of ethylene oxide groups (hydrophilic in nature) with an organic hydrophobic compound, which may be aliphatic or alkyl aromatic in nature. The length of the polyoxyethylene group which is condensed with any particular hydrophobic group can be readily adjusted to yield a water-soluble compound having the desired degree of balance between hydrophilic and hydrophobic elements.

For example, a well-known class of nonionic synthetic detergents is made available on the market under the trade name of "Pluronic". These compounds are formed by condensing ethylene oxide with a hydrophobic base formed by the condensation of propylene oxide with propylene glycol. Other suitable nonionic synthetic detergents include the polyethylene oxide condensates of alkyl phenols, e.g., the condensation products of alkyl phenols having an alkyl group containing from about 6 to about 13 carbon atoms in either a straight chain or branched chain configuration, with ethylene oxide, the said ethylene oxide being present in amounts equal to from about 4 to about 15 moles of ethylene oxide per mole of alkyl phenol.

The water-soluble condensation products of aliphatic alcohols having from about 8 to about 22 carbon atoms, in either straight chain or branched configuration, with ethylene oxide, e.g., a coconut alcohol-ethylene oxide condensate having from about 5 to about 30 moles of ethylene oxide per mole of coconut alcohol, the coconut alcohol fraction having from about 10 to about 14 carbon atoms, are also useful nonionic detergents herein.

Semi-polar nonionic detergents include water-soluble amine oxides containing one alkyl moiety of from about 10 to 20 carbon atoms and 2 moieties selected from the group consisting of alkyl groups and hydroxyalkyl groups containing from 1 to about 3 carbon atoms; water-soluble phosphine oxide detergents containing one alkyl moiety of from about 10 to 20 carbon atoms and 2 moieties selected from the group consisting of alkyl groups and hydroxyalkyl groups containing from 1 to about 3 carbon atoms; and water-soluble sulfoxide detergents containing one alkyl or hydroxyalkyl moiety of from about 10 to about 20 carbon atoms and a moiety selected from the group consisting of alkyl and hydroxyalkyl moieties of from 1 to about 3 carbon atoms.

Ampholytic detergents include derivatives of aliphatic or aliphatic derivatives of heterocyclic secondary and tertiary amines in which the aliphatic moiety can be straight chain or branched and wherein one of the aliphatic substituents contains from about 8 to about 18 carbon atoms and at least one aliphatic substituent contains an anionic water-solubilizing group.

Zwitterionic detergents include derivatives of aliphatic quaternary ammonium, phosphonium and sulfonium compounds in which the aliphatic moieties can be straight chain or branched, and wherein one of the aliphatic substituents contains from about 8 to about 18 carbon atoms and one contains an anionic water-solubilizing group. The quaternary compounds, themselves, e.g. cetyltrimethyl ammonium bromide, can also be used herein.

Other useful detergent compounds herein include the water-soluble salts of esters of alpha-sulfonated fatty acids containing from about 6 to about 20 carbon atoms in the fatty acid group and from 1 to about 10 carbon atoms in the ester group; water-soluble salts of 2-acyloxy-alkane-1-sulfonic acids containing from about 2 to about 9 carbon atoms in the acyl group and from about 9 to about 20 carbon atoms in the alkane moiety; alkyl ether sulfates containing from about 10 to about 20 carbon atoms in the alkyl group and from about 1 to about 12 moles of ethylene oxide; water-soluble salts of olefin sulfonates containing from about 12 to 20 carbon atoms; and beta-alkyloxy alkane sulfonates containing from about 1 to 3 carbon atoms in the alkyl group and from about 8 to 20 carbon atoms in the alkane moiety.

Preferred water-soluble organic detergent compounds herein include linear alkylbenzene sulfonates containing from about 11 to about 13 carbon atoms in the alkyl group; $C_{10-18}$ alkyl sulfates; the $C_{10-16}$ alkyl glyceryl sulfonates; $C_{10-18}$ alkyl ether sulfates, especially wherein the alkyl moiety contains from about 14 to 18 carbon atoms and wherein the average degree of ethoxylation between 1 and 6; $C_{10-18}$ alkyl dimethyl amine oxides, especially wherein the alkyl group contains from about 11 to 16 carbon atoms; alkyldimethyl ammonio propane sulfonates and alkyldimethyl ammonio hydroxy propane sulfonates wherein the alkyl group in both types contains from 14 to 18 carbon atoms; soaps, as hereinabove defined; and the condensation product of $C_{10-18}$ fatty alcohols with from about 3 to about 15 moles of ethylene oxides.

Specific preferred detergents for use herein include: sodium linear $C_{10-13}$ alkylbenzene sulfonates; sodium $C_{12-18}$ alkyl sulfates; sodium salts of sulfated condensation product of $C_{12-18}$ alcohols with from about 1 to about 3 moles of ethylene oxide; the condensation product of a $C_{10-18}$ fatty alcohols with from about 4 to about 10 moles of ethylene oxide; and the water-soluble sodium and potassium salts of higher fatty acids containing from about 10 to about 18 carbon atoms.

It is to be recognized that any of the foregoing detergents can be used separately herein, or as mixtures. Examples of preferred detergent mixtures herein are as follows.

An especially preferred alkyl ether sulfate detergent component of the instant compositions is a mixture of alkyl ether sulfates, said mixture having an average (arithmetic mean) carbon chain length within the range of from about 12 to 16 carbon atoms, preferably from about 14 to 15 carbon atoms, and an average (arithmetic mean) degree of ethoxylation of from about 1 to 4 moles of ethylene oxide, preferably from about 1 to 3 moles of ethylene oxide.

OPTIONAL ADDITIVES

The detergent compositions of the present invention can contain, in addition to the silicone and detergent, water-soluble builders such as those commonly taught for use in detergent compositions. Such auxiliary builders can be employed to sequester hardness ions and to help adjust the pH of the laundering liquor. Such builders can be employed in concentrations of from about 5% to about 95% by weight, preferably from about 10% to about 50% by weight, of the detergent compositions herein to provide their builder and pH-controlling functions. The builders herein include any of the conventional inorganic and organic water-soluble builder salts.

Such builders can be, for example, water-soluble salts of phosphates including tripolyphosphates, pyrophosphates, orthophosphates, higher polyphosphates, carbonates, silicates, and organic polycarboxylates. Specific preferred examples of inorganic phosphate builders include sodium and potassium tripolyphosphates and pyrophosphates.

Nonphosphorus-containing materials can also be selected for use herein as builders.

Specific examples of nonphosphorus, inorganic detergent builder ingredients include water-soluble inorganic carbonate, bicarbonate, and silicate salts. The alkali metal, e.g., sodium and potassium, carbonates, bicarbonates, and silicates are particularly useful herein.

Aluminosilicate ion exchange materials useful in the practice of this invention are commercially available. The aluminosilicates useful in this invention can be crystalline or amorphous in structure and can be naturally-occurring aluminosilicates or synthetically derived. A method for producing aluminosilicate ion exchange materials is discussed in U.S. Pat. No. 3,985,669, Krummel et al, issued Oct. 12, 1976, incorporated herein by reference. Preferred synthetic crystalline aluminosilicate ion exchange materials useful herein are available under the designations Zeolite A, Zeolite B, and Zeolite X. In an especially preferred embodiment, the crystalline aluminosilicate ion exchange material in Zeolite A and has the formula $$Na_{12}[AlO_2)_{12}\cdot(SiO_2)_{12}].xH_2O$$

wherein x is from about 20 to about 30, especially about 27.

Water-soluble, organic builders are also useful herein. For example, the alkali metal, ammonium and substituted ammonium polycarboxylates are useful in the present compositions. Specific examples of the polycarboxylate builder salts include sodium, potassium, ammonium and substituted ammonium salts of ethylenediaminetetraacetic acid, nitrilotriacetic acid, oxydisuccinic acid, mellitic acid, benzene polycarboxylic acid, polyacrylic acid, polymaleic acid, and citric acid.

Other desirable polycarboxylate builders are the builders set forth in U.S. Pat. No. 3,308,067, Diehl, incorporated herein by reference. Examples of such materials include the water-soluble salts of homo- and co-polymers of aliphatic carboxylic acids such as maleic acid, itaconic acid, mesaconic acid, fumaric acid, aconitic acid, citraconic acid, and methylenemalonic acid.

Other suitable non-polymeric polycarboxylates are the polyacetal carboxylates described in U.S. Pat. No. 4,144,226, issued Mar. 13, 1979 to Crutchfield et al, and U.S. Pat. No. 4,246,495, issued Mar. 27, 1979 to Crutchfield et al, both incorporated herein by reference. These polyacetal carboxylates can be prepared by bringing together under polymerization conditions an ester of glyoxylic acid and a polymerization initiator. The resulting polyacetal carboxylate ester is then attached to chemically stable end groups to stabilize the polyacetal carboxylate against rapid depolymerization in alkaline solution, converted to the corresponding salt, and added to a surfactant.

The detergent compositions herein can contain all manner of additional materials commonly found in laundering and cleaning compositions. For example, the compositions can contain thickeners and soil-suspending agents such as carboxymethylcellulose and the like. Enzymes, especially the proteases, amylases and lipases, can also be present herein. Various perfumes, optical bleaches, fillers, anticaking agents, fabric softeners and the like can be present in the compositions to provide the usual benefits occasioned by the use of such materials in detergent compositions. It is to be recognized that all such adjuvant materials are useful herein inasmuch as they are compatible and stable in the presence of the isolated silicone suds suppressor.

The compositions herein can additionally contain from about 0.1% to 10% by weight of one or more bleaching agents. Preferred bleaching agents are hydrogen peroxide addition compounds. The hydrogen peroxide addition compounds may be organic, but are preferably inorganic in nature.

A great variety of these compounds exist. Most of them are prepared by crystallization from solutions containing $H_2O_2$. Others are prepared by drying a slurry containing the corresponding salts and $H_2O_2$. The most useful hydrogen peroxide addition compounds are the perborates, e.g., sodium perborate mono- and tetrahydrates. Sodium perborate monohydrate is preferred. Other valuable hydrogen peroxide addition compounds are the carbonate peroxyhydrates, e.g., $2Na_2CO_3.3H_2O_2$, and the phosphate peroxyhydrates, e.g., sodium pyrophosphate peroxyhydrate $Na_4P_2O_7.2H_2O_2$. The most suitable organic hydrogen peroxide addition compound which can be incorporated into the detergent compositions of the present invention is the urea hydrogen peroxide addition compound of the formula $CO(NH_2)_2.H_2O_2$, because it is one of the few free flowing dry organic hydrogen peroxide addition compounds.

Activators for these bleaches are also desirable additives. Preferred are the activators of U.S. Pat. No. 4,412,934, Chung et al, incorporated herein by reference.

Other bleaching agents which can be used include oxygenating bleaches such as sodium or potassium persulfate, for instance the mixed salt marketed as "Oxone", and organic per acids and peroxides, such as those disclosed in British Pat. Nos. 886,188, 1,293,063 and British Application No. 5896/71. Magnesium salts of the peracids and peracids with high (greater than about 100) melting points and magnesium salts thereof are preferred. Suitable magnesium salts are disclosed in U.S. Pat. Nos. 4,483,781, Hartman, incorporated herein by reference.

Halogen bleaches, for example hypochlorites, or hypobromites, and compounds providing these ions in solution, can also be used in, or with, the compositions herein. Examples are sodium hypochlorite itself, chlorinated trisodium phosphate, and organic N-chloro-compounds such as chlorinated isocyanuric acid compounds. These are particularly useful in automatic dishwashing detergent compositions at concentrations of from 0.1% to 10% by weight.

A finished detergent composition of this invention can contain minor amounts of materials which make the product more attractive. The following are mentioned by way of example: a tarnish inhibitor such as benzotriazole or ethylene thiourea can be added in amounts up to 2% by weight; fluorescers, perfumes and dyes, while not essential, can be added in small amounts. An alkaline material such as sodium or potassium carbonate or hydroxide can be added in minor amounts as supplementary pH adjusters. There may also be mentioned, as suitable additives: bacteriostats, bactericides, corrosion inhibitors such as soluble alkali silicates (preferably sodium silicates having an $SiO_2/Na_2O$ ratio of from 1:1 to 2.8:1), and textile softening agents.

All percentages, parts and ratios herein are by weight unless otherwise specified.

The following examples illustrate the compositions herein.

EXAMPLE I

Design of Experiment

Flakes containing ~10% by weight of a commercially available silicone/silica fluid (~75% polydimethyl siloxane having a viscosity of 20 cs–1,500 cs at 25.0° C.; about 15% siloxane resin; and about 10% silica aerogel having an average ultimate particle size of about 12 millimicrons agglomerated to an average of 1.3–1.7 microns and having a surface area of ~325 $m^2/g$) and ~90% by weight of polyethylene glycol having a molecular weight of about 8,000 (PEG-8000) were produced using a chill roll flaker pilot plant unit. Particle size was controlled by controlling flake thickness and selectively sizing/screening the ground flakes.

Prills containing ~3.5% by weight silicone/silica fluid, ~63% by weight sodium tripolyphosphate (STPP) and the balance PEG-8000 were produced using a fluid bed process. Particle size was controlled by sizing/screening the prills and controlling atomization and fluid bed conditions.

The flakes or prills were admixed into a spray-dried detergent composition containing an anionic/nonionic/cationic surfactant system at levels to deliver a 0.035% silicone/silica level. Product was stored in open cartons under high temperature/high humidity conditions [varying from 79° F. and 50% relative humidity (R.H.) to 93° F. and 86% R.H. each 24 hours] for up to 12 weeks. At regular intervals, the suds profile was measured by conducting a washing machine test in which the suds level is evaluated at several times throughout the wash according to a picture grade scale ranging from 0 to 100, where 0=no suds and 100=full washer, and the results averaged.

Results
Suds Suppressor Stability of Flakes with Different Minimum Particle Dimension as Compared to Prills Containing Hygroscopic Powder
Relative Suds Level vs. Initial*

| | Tyler Mesh Screen Size | Weeks Storage 0 | 4 | 6 | 8 | 12 | Hygroscopic powder |
|---|---|---|---|---|---|---|---|
| Prill | −10/+35** | 0 | +8 | +12 | +27 | +29 | Yes |
| .025 cm thick flake | −10/+20 | 0 | +30 | +28 | +34 | +33 | No |
| .051 cm thick flake | −10/+20 | 0 | −3 | +1 | +2 | +1 | No |
| .112 cm thick*** flake | −10 | 0 | +9 | N.A. | +4 | +4 | No |

*A change of more than +5 is significant. A change of more than +10 is unacceptable.
**−10/+35 refers to a distribution which passes a 10 mesh Tyler screen and is retained on a 35 mesh screen.
***-Made by process of Example 11.

As can be seen from the above, the prills which are the only particles containing water-soluble inorganic salts and particles with a minimum dimension of less than about 0.05 cm (0.02 inch) are unacceptable and particles with a minimum dimension of at least about 0.05 cm and no water-soluble inorganic salt are acceptable.

EXAMPLE II

A.

Flakes containing ~10% by weight of silicone/silica fluid, 0 to 7% by weight of palmitic acid or Hyfac fatty acids, and the balance PEG-8000 were made in the laboratory by mixing the ingredients together such that the silicone droplets were dispersed as small droplets (1–30μ), spreading the mix on a flat surface to allow it to freeze, grinding the solid sheet in a Waring blender, and screening the particles to achieve particles −10/+35 Tyler mesh.

Prills containing ~3.5% by weight of silicone/silica fluid, ~33.5% by weight PEG-8000 and ~63% by weight STPP were produced using a fluid bed process. Particle size was controlled by sizing/screening the prills and controlling atomization and fluid bed conditions.

The flakes, or prills, were admixed into a spray-dried detergent composition containing an anionic/nonionic/cationic surfactant system at levels to deliver a 0.035% silicone/silica level. The suds profile was measured at one, three, nine and twelve minutes in the wash cycle and in the rinse and the suds level graded according to the scale described in Example I.

B.

Flakes containing a carrier material comprising 0 to 3.3% palmitic acid or Hyfac fatty acids and the balance PEG-8000 were made according to the flake procedure described in A. A known weight of flakes was added to a known volume of deionized water and allowed to sit for a specified time. The volume was then filtered and the percent insolubles determined by the weight trapped on filter paper.

Results
A. Relative Suds Picture Grade vs. Prill without fatty acid as in Example I.

| Wash temp (°F.)/ hardness grains/ gallon | % Fatty acid in the flake | Palmitic acid, Minutes in the Wash 1 | 3 | 9 | 12 | Rinse | Hyfac fatty acids, Minutes in the Wash 1 | 3 | 9 | 12 | Rinse |
|---|---|---|---|---|---|---|---|---|---|---|---|
| 95/5 | 7 | +34 | +22 | 0 | +1 | +6 | +33 | +20 | +3 | +2 | −6 |
| | 5 | +32 | +19 | −4 | −8 | −12 | +34 | +18 | +5 | 0 | −2 |
| | 3 | +21 | +6 | −5 | −8 | 0 | +28 | +12 | −5 | −10 | −2 |
| | 1.5 | +13 | +5 | −4 | −7 | −5 | +16 | +6 | −11 | −13 | −7 |
| | .75 | +9 | 0 | −13 | −14 | 0 | | | | | |
| 125/2 | 1.5 | +2 | +5 | −7 | 0 | −4 | −1 | −10 | −16 | −17 | −1 |
| | .75 | +4 | +3 | −7 | −13 | 0 | | | | | |
| 60/10 | 5 | +30 | +24 | +14 | +11 | −1 | +43 | +25 | +21 | +17 | +5 |
| | 3 | +23 | +13 | +13 | +10 | +2 | +25 | +19 | +19 | +13 | +1 |
| | 1.5 | +22 | +11 | +2 | +4 | +2 | +32 | +20 | −1 | 0 | 0 |
| | .75 | +14 | +5 | −11 | −18 | −10 | | | | | |

As can be seen from the above, fatty acids allow too many suds in the wash initially at normal wash conditions unless the level is kept below about 1.5%. At that level the suds level is at a desirable and acceptable level at the start of the wash and lower at the end and in the rinse, which is also desirable B. Rate of Suds Suppressor Solubility (Measured by % Insolubles) as a Function of Fatty Acid Level

| Temperature | % Fatty Acid | % Undissolved Palmitic Acid | Hyfac |
|---|---|---|---|
| Hot (~125° F.) | 0 | 0.5 | 0.5 |
| | 0.8 | 1.7 | 1.2 |
| | 3.3 | 6.6 | 3.9 |
| Warm (~95° F.) | 0 | 1.5 | 1.5 |
| | 0.8 | 3.2 | 4.1 |
| | 3.3 | 10.8 | 8.3 |
| Cold (~60° F.) | 0 | 3.7 | 3.7 |
| | 0.8 | 7.6 | 6.2 |
| | 3.3 | 13.2 | 11.8 |

As can be seen from the above, fatty acids retard the dissolution of the suds suppressor particles thus providing less suds suppression at the start of the wash and more suds suppression later. Once the suds suppressor is in the water it is slowly deactivated by emulsification by the detergent surfactant and by alkalinity.

What is claimed is:

1. A granular detergent composition comprising:

(a) a suds suppressing amount of a stable suds controlling component especially adapted for use in a detergent composition, comprising a silicone suds controlling agent having an average droplet diameter of from about 1 to about 50 microns releasably incorporated in a water-soluble or water dispersible, substantially non-surface active, detergent-impermeable, and non-hygroscopic carrier, said component being substantially free of water-soluble relatively hygroscopic inorganic salts and in the form of an irregularly shaped particle having a minimum dimension of not less than about 0.05 cm and the maximum dimension being at least about 20% greater than the minimum dimension; and (b) a sudsing detergent component selected from the group consisting of anionic, nonionic, zwitterionic, ampholytic, and cationic detergents and mixtures thereof.

2. The composition of claim 1 in which there is from about 10% to about 50% of said detergent component and from 0.005% to about 10% of the silicone suds controlling agent in a carrier at a greater than about 2:1 ratio of carrier to silicone.

3. The composition of claim 2 in which said droplet diameter is from about 5 to about 30 microns; there is from about 10% to about 30% detergent component; and from about 0.01% to about 0.5% silicone suds controlling agent in a polyethylene glycol carrier at a ratio of carrier to silicone of from about 5:1 to about 100:1.

4. A composition according to claim 3 wherein the detergent compound comprises a water-soluble salt of an organic sulfuric reaction product having in its molecular structure an alkyl group containing from about 8 to about 22 carbon atoms and a sulfonic acid or sulfuric acid ester group.

5. A composition according to claim 3 wherein the detergent compound is selected from the group consisting of sodium linear $C_{10}$–$C_{13}$ alkylbenzene sulfonate; sodium $C_{10}$–$C_{18}$ alkyl sulfate; the sodium salt of a sulfated condensation product of a $C_{10}$–$C_{18}$ alcohol with from about 1 to about 3 moles of ethylene oxide; the condensation product of a $C_{10}$–$C_{18}$ fatty alcohol with from about 4 to about 10 moles of ethylene oxide; the water-soluble sodium and potassium salts of higher fatty acids containing from about 10 to about 18 carbon atoms; and mixtures thereof.

6. A composition according to claim 5 containing, as an additional component, from about 5% to about 95% by weight of a water-soluble detergency builder.

7. A composition according to claim 6 wherein there is from about 10% to about 50% of said detergency auxiliary builder which is selected from the group consisting of sodium tripolyphosphate and potassium tripolyphosphate.

8. A composition according to claim 6 wherein the detergency builder is selected from the group consisting of sodium carbonate, sodium bicarbonate, sodium silicate, sodium citrate, sodium nitrilotriacetate, and mixtures thereof.

9. The composition of claim 1 in which said droplet diameter is from about 1 to about 50 microns; there is from about 10% to about 50% detergent component; and from about 0.01% to about 0.5% silicone suds controlling agent in a polyethylene glycol carrier at a ratio of carrier to silicone of from about 5:1 to about 100:1, and in which the carrier also comprises from about 0.2% to about 15% of fatty acids containing from about 12 to about 30 carbon atoms.

10. The composition of claim 9 in which the carrier comprises from about 0.25% to about 2% of fatty acids containing from about 14 to about 20 carbon atoms.

11. A composition according to claim 9 wherein the detergent compound comprises a water-soluble salt of an organic sulfuric reaction product having in its molecular structure an alkyl group containing from about 8 to about 22 carbon atoms and a sulfonic acid or sulfuric acid ester group.

12. A composition according to claim 11 wherein the detergent compound is selected from the group consisting of sodium linear $C_{10}$–$C_{13}$ alkylbenzene sulfonate; sodium $C_{10}$–$C_{18}$ alkyl sulfate; the sodium salt of a sulfated condensation product of a $C_{10}$–$C_{18}$ alcohol with from about 1 to about 3 moles of ethylene oxide; the condensation product of a $C_{10}$–$C_{18}$ fatty alcohol with from about 4 to about 10 moles of ethylene oxide; the water-soluble sodium and potassium salts of higher fatty acids containing from about 10 to about 18 carbon atoms; and mixtures thereof.

13. A composition according to claim 11 containing, as an additional component, from about 5% to about 95% by weight of a water-soluble detergency builder.

14. A composition according to claim 13 wherein the auxiliary builder is selected from the group consisting of sodium tripolyphosphate and potassium tripolyphosphate.

15. A composition according to claim 13 wherein the detergency builder is selected from the group consisting of sodium carbonate, sodium bicarbonate, sodium silicate, sodium citrate, sodium nitrilotriacetate, and mixtures thereof.

* * * * *